US008400364B2

(12) United States Patent
Kotaka et al.

(10) Patent No.: US 8,400,364 B2
(45) Date of Patent: Mar. 19, 2013

(54) MULTIBAND PLANAR ANTENNA AND ELECTRONIC EQUIPMENT

(75) Inventors: Yuki Kotaka, Tachikawa (JP); Shigeru Yagi, Tokyo (JP)

(73) Assignee: Casio Computer Co., Ltd., Tokyo (JP)

( * ) Notice: Subject to any disclaimer, the term of this patent is extended or adjusted under 35 U.S.C. 154(b) by 389 days.

(21) Appl. No.: 12/776,583

(22) Filed: May 10, 2010

(65) Prior Publication Data

US 2010/0302111 A1 Dec. 2, 2010

(30) Foreign Application Priority Data

May 27, 2009 (JP) ..... 2009-127122

(51) Int. Cl.
*H01Q 1/24* (2006.01)

(52) U.S. Cl. ..... 343/702; 343/700 MS

(58) Field of Classification Search ..... 343/702, 343/846, 848, 700 MS
See application file for complete search history.

(56) References Cited

U.S. PATENT DOCUMENTS

| | | | | |
|---|---|---|---|---|
| 5,926,150 | A | 7/1999 | McLean et al. | |
| 6,421,014 | B1 | 7/2002 | Sanad | |
| 6,529,170 | B1 | 3/2003 | Nishizawa et al. | |
| 6,600,448 | B2 | 7/2003 | Ikegaya et al. | |
| 6,621,464 | B1 | 9/2003 | Fang et al. | |
| 6,847,328 | B1 | 1/2005 | Libonati et al. | |
| 6,853,336 | B2 | 2/2005 | Asano et al. | |
| 6,870,504 | B2 | 3/2005 | Ikegaya et al. | |
| 6,906,677 | B2 | 6/2005 | Yamamoto et al. | |
| 6,917,333 | B2 | 7/2005 | Ikegaya et al. | |
| 6,961,028 | B2 * | 11/2005 | Joy et al. | 343/895 |
| 7,042,415 | B2 * | 5/2006 | Cheng | 343/795 |
| 7,151,500 | B2 * | 12/2006 | Su et al. | 343/795 |
| 7,176,843 | B2 | 2/2007 | Shimasaki et al. | |
| 7,248,224 | B2 | 7/2007 | Yuanzhu | |
| 7,265,720 | B1 | 9/2007 | Ponce De Leon et al. | |

(Continued)

FOREIGN PATENT DOCUMENTS

| | | | |
|---|---|---|---|
| DE | 101 47 921 | A1 | 4/2003 |
| DE | 20 2006 019 045 | U1 | 3/2007 |

(Continued)

OTHER PUBLICATIONS

Japanese Office Action dated Mar. 29, 2011 (and English translation thereof) in counterpart Japanese Application No. 2009-127122.

(Continued)

*Primary Examiner* — Hoanganh Le
(74) *Attorney, Agent, or Firm* — Holtz, Holtz, Goodman & Chick, P.C.

(57) ABSTRACT

Disclosed is a multiband planar antenna including: an insulating film, a first antenna section and a second antenna section facing to the first antenna section across a feeding point on a film, wherein the first antenna section includes: a first antenna element including a side having a length in an extending direction corresponds to a first resonance frequency; a shorter second antenna element at a predetermined distance from and in parallel with the first antenna element; and a first coupling section to couple the first and second antenna elements, wherein a length in the extending direction of a first clearance corresponds to a resonance frequency higher than the first resonance frequency, and wherein the second antenna section includes: third and fourth antenna elements; a second coupling section; and a second clearance similar to the above.

5 Claims, 15 Drawing Sheets

U.S. PATENT DOCUMENTS

| | | | | |
|---|---|---|---|---|
| 7,372,406 | B2 | 5/2008 | Shiotsu et al. | |
| 7,375,686 | B2 | 5/2008 | Ku et al. | |
| 7,389,129 | B2 | 6/2008 | Shoji | |
| 7,423,598 | B2 | 9/2008 | Bit-Babik et al. | |
| 7,605,759 | B2 * | 10/2009 | Moon et al. | 343/700 MS |
| 7,612,720 | B2 | 11/2009 | Kerselaers | |
| 7,777,682 | B2 | 8/2010 | Yagi | |
| 7,864,115 | B2 | 1/2011 | Yamazaki et al. | |
| 7,889,139 | B2 | 2/2011 | Hobson et al. | |
| 2003/0045324 | A1 | 3/2003 | Nagumo et al. | |
| 2004/0137971 | A1 | 7/2004 | Shoji | |
| 2004/0201528 | A1 | 10/2004 | Lee et al. | |
| 2004/0217916 | A1 | 11/2004 | Quintero Illera et al. | |
| 2004/0222936 | A1 | 11/2004 | Hung et al. | |
| 2004/0246188 | A1 | 12/2004 | Egashira | |
| 2005/0035919 | A1 | 2/2005 | Yang et al. | |
| 2005/0200556 | A1 | 9/2005 | Lin et al. | |
| 2005/0212706 | A1 | 9/2005 | Ying et al. | |
| 2005/0280579 | A1 | 12/2005 | Liang et al. | |
| 2006/0001590 | A1 | 1/2006 | Hung et al. | |
| 2006/0017643 | A1 | 1/2006 | Shimasaki et al. | |
| 2006/0022888 | A1 | 2/2006 | Cheng | |
| 2006/0132362 | A1 | 6/2006 | Yuanzhu | |
| 2006/0170605 | A1 | 8/2006 | Tang et al. | |
| 2006/0187135 | A1 | 8/2006 | Maniwa et al. | |
| 2006/0208950 | A1 | 9/2006 | Tago | |
| 2007/0040751 | A1 | 2/2007 | Boyle | |
| 2007/0052610 | A1 | 3/2007 | Lee | |
| 2007/0103367 | A1 | 5/2007 | Wang | |
| 2007/0268190 | A1 | 11/2007 | Huynh | |
| 2008/0180339 | A1 | 7/2008 | Yagi | |
| 2008/0180342 | A1 | 7/2008 | Kerselaers | |
| 2008/0284662 | A1 | 11/2008 | Yagi | |
| 2008/0316121 | A1 | 12/2008 | Hobson et al. | |
| 2009/0167619 | A1 | 7/2009 | Yagi | |
| 2009/0204372 | A1 * | 8/2009 | Johnston et al. | 702/191 |
| 2009/0295652 | A1 | 12/2009 | Yagi | |

FOREIGN PATENT DOCUMENTS

| | | | |
|---|---|---|---|
| EP | 1 345 282 | A1 | 9/2003 |
| EP | 1 617 514 | A1 | 1/2006 |
| JP | 63-254803 | A | 10/1988 |
| JP | 10-093332 | A | 4/1998 |
| JP | 2001-185938 | A | 7/2001 |
| JP | 2002-055733 | A | 2/2002 |
| JP | 2003-078333 | A | 3/2003 |
| JP | 2004-072605 | A | 3/2004 |
| JP | 2004-159029 | A | 6/2004 |
| JP | 2004-356823 | A | 12/2004 |
| JP | 3622959 | B2 | 2/2005 |
| JP | 2005-130249 | A | 5/2005 |
| JP | 3656610 | B2 | 6/2005 |
| JP | 2005-284516 | A | 10/2005 |
| JP | 2005-286915 | A | 10/2005 |
| JP | 2006-067234 | A | 3/2006 |
| JP | 2006-180150 | A | 7/2006 |
| JP | 2006-254081 | A | 9/2006 |
| JP | 3830358 | B2 | 10/2006 |
| JP | 2006-529070 | T | 12/2006 |
| JP | 2007-013596 | A | 1/2007 |
| JP | 2007-027906 | A | 2/2007 |
| JP | 2007-043594 | A | 2/2007 |
| JP | 2007-124346 | A | 5/2007 |
| JP | 2008-502205 | T | 1/2008 |
| WO | WO 01/15270 | A1 | 3/2001 |
| WO | WO 2004/097980 | A1 | 11/2004 |
| WO | WO 2006/114724 | A1 | 11/2006 |

OTHER PUBLICATIONS

Extended European Search Report dated Jul. 2, 2010 (in English), issued in counterpart European Application No. 10161739.7.

U.S. Appl. No. 12/011,952; First Named Inventor: Shigeru Yagi; Title: "Plane Circular Polarization Antenna and Electronic Apparatus", filed Jan. 30, 2008, published as.

U.S. Appl. No. 12/473,680; First Named Inventor: Shigeru Yagi; Title: "Planar Antenna and Electronic Device", filed May 28, 2009, published as US 2009/0295652.

* cited by examiner

MULTIBAND PLANAR ANTENNA AND ELECTRONIC EQUIPMENT

BACKGROUND OF THE INVENTION

1. Field of the Invention

The present invention relates to a multiband planar antenna and electronic equipment equipped with the multiband planar antenna.

2. Background Art

There has previously been known a portable device having a wireless communication function such as a handheld terminal and a Personal Digital Assistant (PDA). The portable device has an antenna for wireless communication.

As the antenna for wireless communication to be mounted on the portable device, there has been known a single band planar antenna (for example, see Japanese Patent Application Laid-Open Publication No. 2004-356823 and Japanese Patent Application Laid-Open Publication No. 2002-55733).

As the single band planar antenna, there has been known a planar antenna in which two flat plates are provided in the same plane so as to face to each other. This planar antenna resonates with one resonance frequency which is determined depending on a length of each of the flat plates.

However, the conventional planar antenna has been a single band planar antenna in which the number of resonance frequency band is one (1). In order to adapt to wireless communication such as mobile communication in which there are a plurality of resonance frequency bands, making the planar antenna become a multiband antenna has been required.

The planar antenna can be the multiband antenna by being provided with an antenna element including a plurality of sides each of which resonates with a different frequency and has a different length from those of other sides. A planar antenna 50 will be explained with reference to FIGS. 18-20.

FIG. 18 shows a schematically configuration of the planar antenna 50 which has two sides having different lengths.

FIG. 19 shows a current distribution of the planar antenna 50.

FIG. 20 shows S parameter with respect to a frequency of the planar antenna 50.

As shown in FIG. 18, the planar antenna 50 including two sides of different lengths will be described. The planar antenna 50 is a flat plate antenna. The planar antenna 50 is equipped with antenna elements 53, 54. The antenna elements 53, 54 are connected to a coaxial cable at a feeding point P. In FIG. 18, details of substrates of the antenna elements 53, 54 and of the feeding point P of the planar antenna 50 are omitted.

The antenna elements 53, 54 are line-symmetric across the feeding point P, each having an L-shape and a planar shape, and face to each other on the same plane. The antenna element 53 has a lower side 531 and an upper side 532. The antenna element 54 has a lower side 541 and an upper side 542. The lengths of the lower sides 531 and 541 are same as each other, each of the length being considered to be length L51. The lengths of the upper sides 532 and 542 are same as each other, each of the length being considered to be length L52. The length L51 and the length L52 have a relation of L51>L52.

Antenna current flowing through the planar antenna 50 when it receives radio wave having a frequency f51 corresponding to the length L51 and a frequency f52 corresponding to the length L52 was simulated. A frequency which corresponds to a wavelength λ51 in case of L51=λ51/4 (λ51: wavelength of radio wave) is considered to be the frequency f51. A frequency which corresponds to a wavelength λ52 in case of L52=λ52/4 (λ52: wavelength of radio wave) is considered to be the frequency f52. Here the values of f51 and f52 are considered such that f51=1.57 [GHz] and f52=1.91 [GHz].

As a result of such simulation, with respect to the frequency f51 and the frequency f52, the same current distribution of the antenna current shown in FIG. 19 was obtained.

In FIG. 19, as the value (Amps/m) of the antenna current changes from low to high, a color changes from black to white. The same can be said for subsequent drawings of current distribution of the antenna current.

In addition, characteristics of S parameter with respect to the frequency of the planar antenna 50 were simulated. The smaller the value of S parameter, the greater the resonance of the antenna. This simulation result shows antenna characteristics in which the number of drops of graph of S parameter was one (1) and its value was 1.57 [GHz], as shown in FIG. 20. Since the number of the drops was one (1), the number of frequency band to resonate was also one (1), and thereby the planar antenna 50 had characteristics of single band antenna.

Thus, it has been impossible to allow the planar antenna to have multiband by merely providing the antenna elements having two sides of different lengths.

SUMMARY OF THE INVENTION

The main object of the present invention is to allow a planar antenna to have a plurality of resonance frequency band.

There is provided with a multiband planar antenna according to the present invention including:

an insulating film;

a first antenna section formed on the film; and a second antenna section formed on the film, the second antenna being placed so as to face to the first antenna section across a feeding point, wherein the first antenna section includes:

a first antenna element including a side having a length in an extending direction corresponds to a first resonance frequency, the first antenna element having a band-like shape;

a second antenna element placed at a predetermined distance from the first antenna element so as to be in parallel with the first antenna element, the second antenna element being shorter than the first antenna element and having a band-like shape; and a first coupling section to couple the first antenna element with the second antenna element, wherein a length in the extending direction of a first clearance corresponds to a resonance frequency higher than the first resonance frequency, the first clearance being a portion of the first antenna section between the first antenna element and the second antenna element and corresponding to a length in the extending direction of the second antenna element except the first coupling section, and wherein the second antenna section includes:

a third antenna element including a side having a length in an extending direction corresponds to the first resonance frequency, the third antenna element having a band-like shape;

a fourth antenna element placed at a predetermined distance from the third antenna element so as to be in parallel with the third antenna element, the fourth antenna element being shorter than the third antenna element and having a band-like shape; and a second coupling section to couple the third antenna element with the fourth antenna element, wherein a length in the extending direction of a second clearance corresponds to a resonance frequency higher than the first resonance frequency, the second clearance being a portion of the second antenna section between the third antenna element and the fourth antenna element and corresponding to a length in the extending direction of the fourth antenna element except the second coupling section.

There is provided with electronic equipment according to the present invention including:

a multiband planar antenna containing: an insulating film; a first antenna section formed on the film; and a second antenna section formed on the film, the second antenna being placed so as to face to the first antenna section across a feeding point, wherein the first antenna section includes: a first antenna element including a side having a length in an extending direction corresponds to a first resonance frequency, the first antenna element having a band-like shape; a second antenna element placed at a predetermined distance from the first antenna element so as to be in parallel with the first antenna element, the second antenna element being shorter than the first antenna element and having a band-like shape; and a first coupling section to couple the first antenna element with the second antenna element, wherein a length in the extending direction of a first clearance corresponds to a resonance frequency higher than the first resonance frequency, the first clearance being a portion of the first antenna section between the first antenna element and the second antenna element and corresponding to a length in the extending direction of the second antenna element except the first coupling section, and wherein the second antenna section includes: a third antenna element including a side having a length in an extending direction corresponds to the first resonance frequency, the third antenna element having a band-like shape; a fourth antenna element placed at a predetermined distance from the third antenna element so as to be in parallel with the third antenna element, the fourth antenna element being shorter than the third antenna element and having a band-like shape; and a second coupling section to couple the third antenna element with the fourth antenna element, wherein a length in the extending direction of a second clearance corresponds to a resonance frequency higher than the first resonance frequency, the second clearance being a portion of the second antenna section between the third antenna element and the fourth antenna element and corresponding to a length in the extending direction of the fourth antenna element except the second coupling section;

a communication section to perform wireless communication with external equipment through the multiband planar antenna; and a control section to control the communication section.

According to the present invention, since resonance occurs at the first frequency corresponding to the length of the first and third antenna elements in the extending direction, and at the resonance frequency corresponding to the length of the first and second clearances in the extending direction, the planar antenna can have a plurality of resonance frequency bands.

DETAILED DESCRIPTION OF THE PREFERRED EMBODIMENTS

In the following, preferred embodiments and variations thereof according to the present invention will be described with reference to the drawings. Incidentally, the present invention is not limited to illustrated examples.

The embodiments of the present invention will be described with reference to FIGS. 1-13. Firstly, device configurations of a multiband planar antenna 30 and a handheld terminal 1 according to the embodiment will be explained with reference to FIGS. 1-3.

Figure 1:
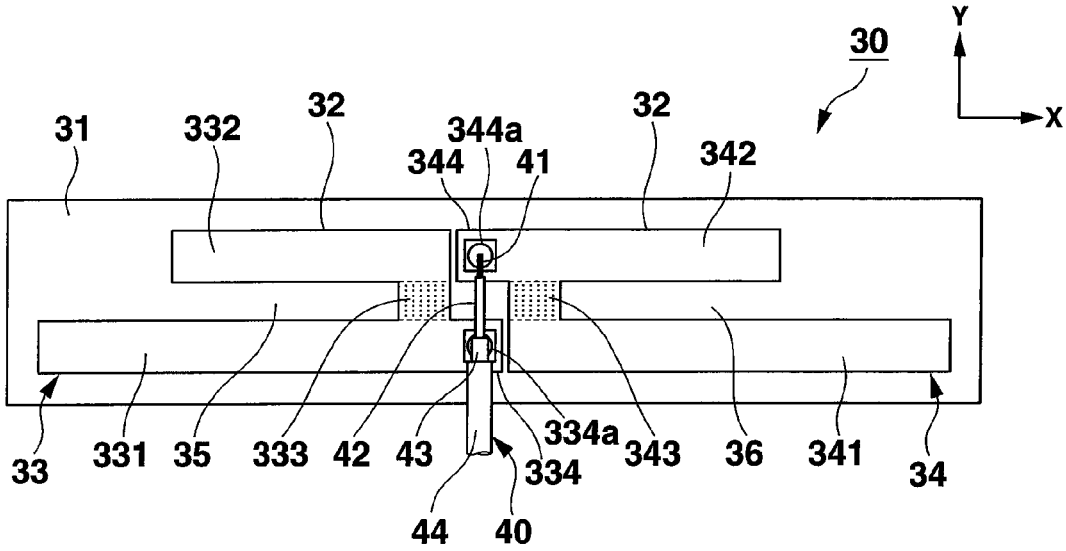
FIG. 1 is a diagram showing a planar configuration of a multiband planar antenna according to an embodiment of the present invention.

FIG. 1 shows a configuration of the multiband planar antenna 30 according to the embodiment.

With reference to FIG. 1, a configuration of the multiband planar antenna 30 according to the embodiment will be explained.

The multiband planar antenna 30 is a multiband antenna as a balanced antenna having two resonance frequency bands. The balanced antenna is an antenna in which electric potential is distributed symmetrically.

As shown in FIG. 1, the multiband planar antenna 30 includes a film 31 and an antenna conductor section 32. The film 31 is a film of Flexible Print Circuit (FPC) and composed of insulating body such as polyimide. The antenna conductor section 32 is composed of a conducting planar body such as copper foil formed on the film 31.

The antenna conductor section 32 includes antenna sections 33, 34 as a first antenna element and a second antenna element. The antenna sections 33, 34 are an antenna section of a conducting body which is integrally configured except soldering pads 334*a*, 344*a*.

The antenna section 33 includes antenna elements 331, 332 as a first antenna element and a second antenna element, a coupling section 333 as a first coupling section, a connecting section 334, and a soldering pad 334*a*. The antenna section 34 includes antenna elements 341, 342 as a third antenna element and a fourth antenna element, a coupling section 343 as a second coupling section, a connecting section 344, and a soldering pad 344*a*.

The antenna element 331 is a belt-like antenna element of a conducting body. The antenna element 332 is an antenna element of a conducting body which is placed at a predetermined distance from the antenna element 331 in parallel with an extending direction (longitudinal direction, X direction) of the antenna element 331. The coupling section 333 is a conductor section which is placed between the antenna elements 331, 332 in a direction (Y direction) perpendicular to an extending direction of the antenna elements 331, 332 and couples ends of the antenna elements 331, 332 to each other. As described later, cut lines (dotted lines) are made in the coupling section 333. The connecting section 334 is a conductor section which is placed in an extending line of the antenna element 331 on the side of the coupling section 333 to connect the coaxial cable 40. The soldering pad 334*a* is a conductor section for soldering provided on the connecting section 334, to which an external conducting body 43 is attached by soldering.

The antenna element 341 is a belt-like antenna element of a conducting body. The antenna element 342 is an antenna element of a conducting body which is placed at a predetermined distance from the antenna element 341 in parallel with an extending direction (longitudinal direction, X direction) of the antenna element 341. The coupling section 343 is a conductor section which is placed between the antenna elements 341, 342 in a direction (Y direction) perpendicular to an extending direction of the antenna elements 341, 342 and couples ends of the antenna elements 341, 342 to each other. As described later, cut lines (dotted lines) are made in the coupling section 343. The connecting section 344 is a conductor section which is placed in an extending line of the antenna element 342 on the side of the coupling section 343 to connect the coaxial cable 40. The soldering pad 344*a* is a conductor section for soldering provided on the connecting section 344, to which a core wire 41 is attached by soldering.

The lengths of the antenna elements 331, 341 in X direction are same as each other. The lengths of the antenna elements 332, 342 in X direction are same as each other. A rectangular portion of a plane surface between the antenna elements 331, 332 corresponding to a length in X direction of the antenna element 332 except the coupling section 333 is considered to be a clearance 35 as a first clearance. Similarly, a rectangular portion of a plane surface between the antenna elements 341, 342 corresponding to a length in X direction of the antenna element 342 except the coupling section 343 is considered to be a clearance 36 as a second clearance. The lengths in X direction of the clearances 35, 36 are same as each other. The length in X direction of the antenna element 331 is larger than the length in X direction of the clearances 35.

The coaxial cable 40 is a cable to connect between a later-described wireless communication section 16 and a GPS section 17, and the multiband planar antenna 30. The coaxial cable 40 includes the core wire 41, an insulating body 42, the external conducting body 43 and a protective covering section 44.

The core wire 41 is an inner conducting body such as copper line whose surface perpendicular to an axial direction has a circular shape, and which is attached to the soldering pad 344*a* by soldering. The insulating body 42 is an insulation section such as polyethylene which is co-axial with the core wire 41 and covers the core wire 41. The external conducting body 43 is an insulation section such as woven copper line which is co-axial with the core wire 41 and covers the insulating body 42, and which is attached to the soldering pad 334*a* by soldering. The protective covering section 44 is an insulation section such as vinyl which is co-axial with the core wire 41 and covers the external conducting body 43.

The other end of the coaxial cable 40 is connected to the wireless communication section 16 and the GPS section 17. Specifically, the core wire 41 at the other end of the coaxial cable 40 is connected to terminals of the wireless communication section 16 and the GPS section 17, and the external conducting body 43 at the other end of the coaxial cable 40 is connected to a ground of the wireless communication section 16 and the GPS section 17. High frequency power is fed from the wireless communication section 16 to the multiband planar antenna 30 through the coaxial cable 40. Hereinafter the connecting point of the coaxial cable 40 and the connecting sections 334, 344 is considered to be the feeding point P.

Next, the handheld terminal 1 as electronic equipment on which the multiband planar antenna 30 is mounted will be described with reference to FIGS. 2 and 3.

Figure 2A:
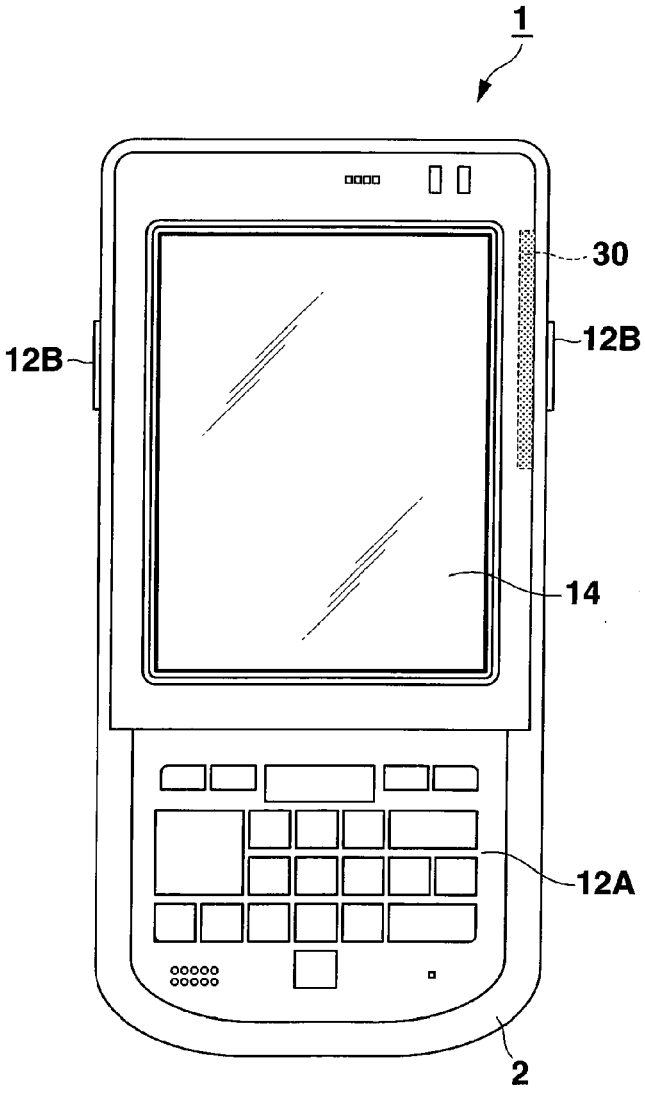
FIG. 2A is a front view showing an appearance configuration of a handheld terminal.

FIG. 2A shows a configuration of a front appearance of the handheld terminal 1.

Figure 2B:
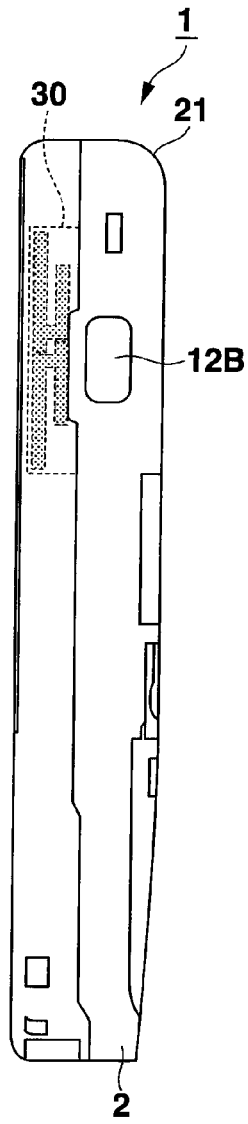
FIG. 2B is a side view showing an appearance configuration of a handheld terminal.

FIG. 2B shows a configuration of a side appearance of the handheld terminal 1.

Figure 3:
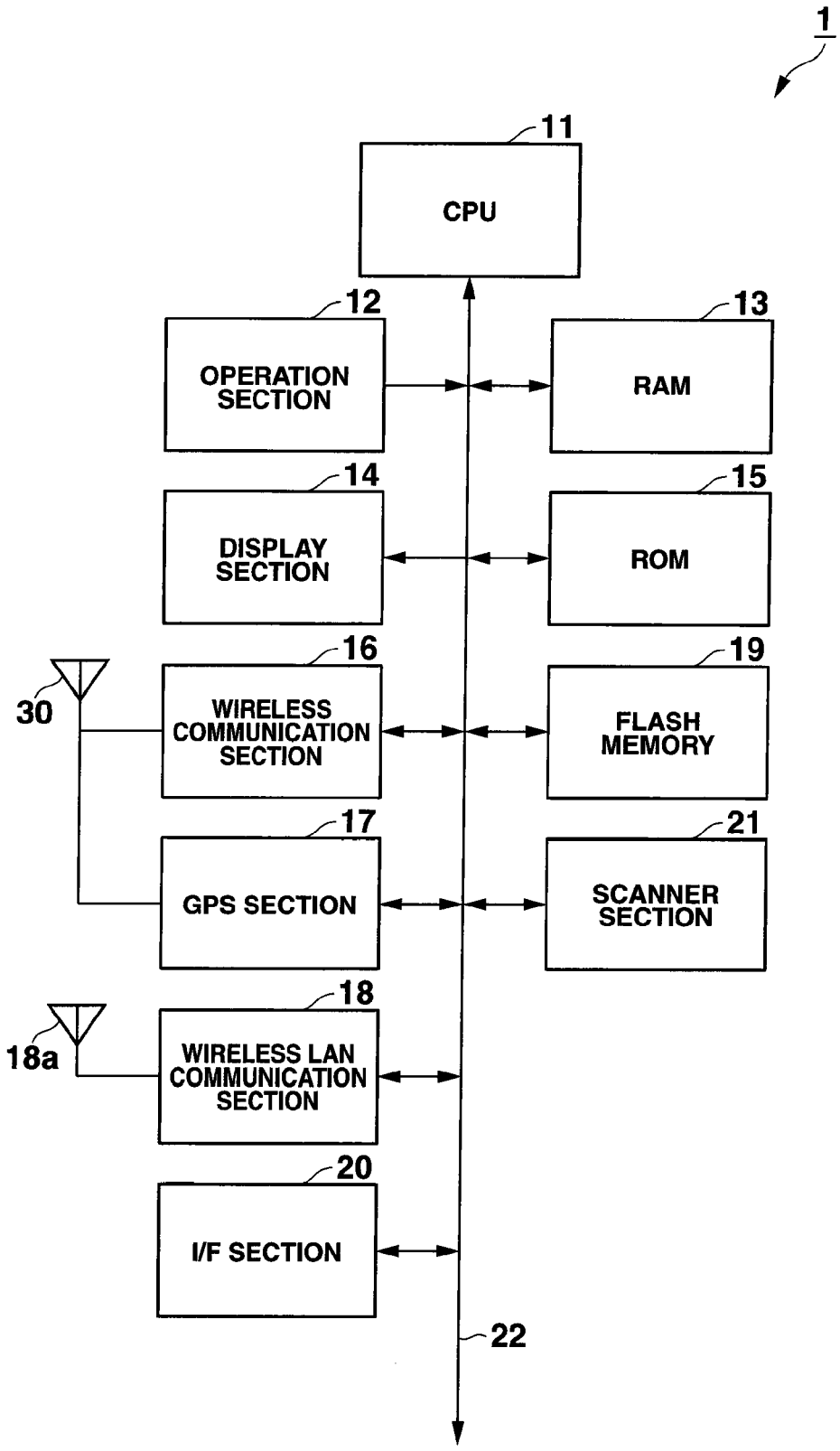
FIG. 3 is a block diagram showing a functional configuration of the handheld terminal.

FIG. 3 shows a functional configuration of the handheld terminal 1.

The handheld terminal 1 is a portable terminal which is used in a supermarket, a convenience store, private shop or the like. The handheld terminal 1 includes a function to receive information upon an operation of a user, a function to store the information, a function to scan a barcode and the like, a function to perform wireless communication with an external equipment via an access point by wireless communication Local Area Network (LAN) system, a mobile communication function, a function to measure a current location of its own device by using Global Positioning System (GPS), and so on.

As shown in FIG. 2A, the handheld terminal 1 includes a case section 2. The handheld terminal 1 is equipped with a display section 14 and various keys 12A at the front of the case section 2.

As shown in FIG. 2B, the handheld terminal 1 is equipped with trigger keys 12B on both side surfaces of the case section 2, and a scanner section 21 on an edge of the case section 2. The handheld terminal 1 is further includes the multiband planar antenna 30 inside the case section 2.

The case section 2 is a case section of the handheld terminal 1. The various keys 12A includes keys for inputting characters such as letters and figures, various function keys, and so on. The trigger key 12B is a key to receive an input of trigger operation of barcode scanning by the scanner section 21. The various keys 12A may include a trigger key for barcode scanning by the scanner section 21. The scanner section 21 is a part to irradiate a barcode with light such as laser light to receive a reflected light to binarize it to read barcode data.

As shown in FIG. 3, the handheld terminal 1 includes a Central Processing Unit (CPU) 11 as a control section, an operation section 12, a Random Access Memory (RAM) 13, a display section 14, a Read Only Memory (ROM) 15, the multiband planar antenna 30, the wireless communication section 16 as a communication section, the GPS section 17, an antenna 18*a*, a wireless LAN communication section 18, a flash memory 19, an Inter Face (IF) section 20 and the scanner section 21 inside the handheld terminal 1. The CPU 11, the operation section 12, the RAM 13, the display section 14, the ROM 15, the wireless communication section 16, the GPS section 17, the wireless LAN communication section 18, the flash memory 19, the I/F section 20, the scanner section 21 and the bus 22 are connected to one another via a bus 22.

The CPU 11 controls each section of the handheld terminal 1. The CPU 11 expands a program specified among system programs and various application programs stored in the ROM 15 in the RAM 13, and performs various processing in cooperation with the program expanded in the RAM 13.

The CPU 11 receive an input of operation information via the operation section 12, reads various pieces of information from the ROM 15, and reads/writes the various pieces of information from/in the flash memory 19. The CPU 11 communicates with a base station (external equipment relayed by a base station) through the wireless communication section 16 and the multiband planar antenna 30 in cooperation with the various programs, and measures a current location of the handheld terminal 1 by using the multiband planar antenna 30 and the GPS section 17. The CPU 11 also communicates with the access point (external equipment relayed by the access point) through the wireless LAN communication section 18 and the antenna 18*a* in cooperation with the various programs, reads the barcode data by using the scanner section 21, and performs wire communication through the I/F section 20.

The operation section 12 includes the various keys 12A and the trigger key 12B, and outputs a key input signal of each key depressed by an operator to the CPU 11. The operation section 12 may be configured integrally with the display section 14 as a touch pad of a touch panel.

The RAM 13 is a volatile memory to temporarily store information, and has a work area in which various programs to be executed, data of these programs, and so on are stored. The display section 14 is composed of Liquid Crystal Display (LCD), Electro Luminescent Display (ELD) or the like, and performs various displays according to a display signal from the CPU 11.

The ROM 15 is a storage section exclusively for reading in which various programs and pieces of data are stored.

The wireless communication section 16 is connected with the multiband planar antenna 30, and performs communication to transmit information to the base station by mobile communication system using the multiband planar antenna 30. In the embodiment, the communication section 16 is explained as a communication section to perform wireless communication at 1.9 [GHz] band as a frequency band to be used in upstream in Frequency Division Duplex (FDD) communication system of Wideband Code Division Multiple Access (W-CDMA) which is third-generation mobile communication system. The wireless communication section 16 demodulates an electric signal of received radio wave of W-CDMA input from the multiband planar antenna 30 to output it to the CPU 11. The multiband planar antenna 30 is a multiband planar antenna which is matched on two frequency bands of 1.57 [GHz] for GPS communication and 1.9 [GHz] for mobile communication system. However, the wireless communication section 16 is not limited to the above, and a configuration where the multiband planar antenna 30 and the wireless communication section 16 perform wireless communication at a frequency band of other mobile communication system or wireless communication of wireless communication system of devices other than a mobile phone.

The GPS section 17 is connected to the multiband planar antenna 30, and receives radio wave of a GPS signal whose frequency is 1.575 [GHz] transmitted from a GPS satellite by communication of GPS communication system through the multiband planar antenna 30. The CPS section 17 demodulates the received GPS signal to obtain GPS information, and generates current positional information (latitude and longitude information) of the handheld terminal 1 based on the GPS information to output it to the CPU 11.

The wireless LAN communication section 18 is connected to the antenna 18*a*, and transmits/receives information to/from the access point via the antenna 18*a* by wireless LAN communication system.

The flash memory 19 is a storage section which enables reading/writing information such as various pieces of data therefrom/thereto.

The I/F section 20 transmits/receives information to/from the external equipment through a communication cable. The I/F section 20 is a wire communication section in Universal Serial Bus (USB) system, for example.

The scanner section 21 is equipped with a light emitting section to emit light such as laser light, a light receiving section, a gain circuit, a binarization circuit, and so on. In the scanner section 21, the light emitting section irradiates the barcode with the light emitted therefrom, the light receiving section receives a reflected light to convert it into an electric signal, the gain circuit amplifies the electric signal, and the binarization circuit converts the electric signal into monochrome barcode image data. Thus, the scanner section 32 reads the barcode image to output the barcode image data to the CPU 11.

Figure 4:
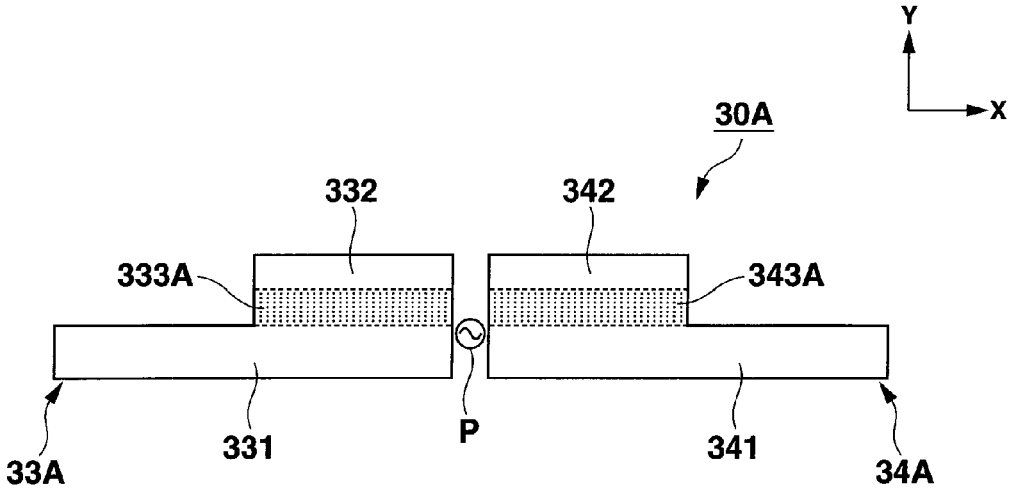
FIG. 4 is a diagram showing a planar antenna before removing a part of a coupling section.
Figure 5:
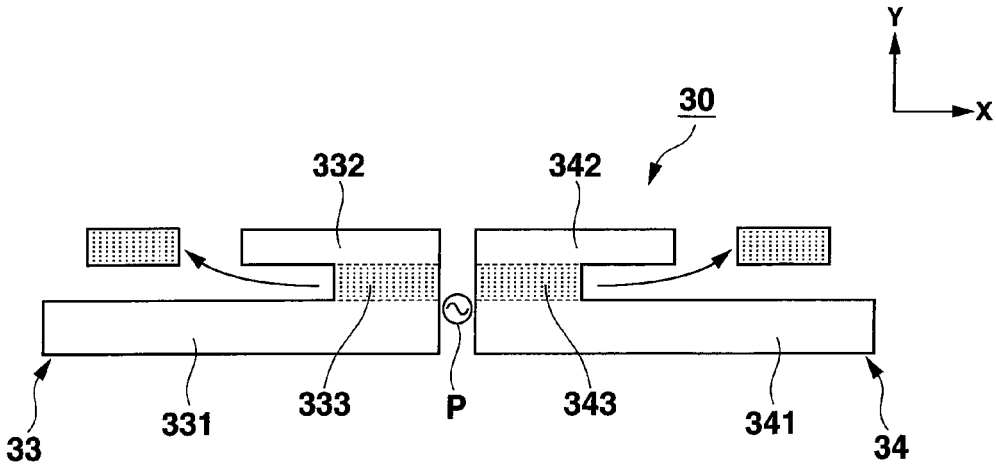
FIG. 5 is a diagram showing the multiband planar antenna after removing the part of the coupling section.

Next, a method for adjusting resonance frequency when the multiband planar antenna 30 is manufactured with reference to FIGS. 4 and 5.

FIG. 4 shows a planar antenna 30A before removing a part of a coupling section.

FIG. 5 shows the multiband planar antenna 30 after removing the part of the coupling section.

In FIGS. 4 and 5, the film of the multiband planar antenna (planar antenna) and the connecting section of the coaxial cable 40 are omitted, and only the antenna conductor section and the feeding point P are illustrated. The same applies to other drawings.

In the method for manufacturing the multiband planar antenna 30, the planar antenna 30A shown in FIG. 4 is manufactured. The planar antenna 30A includes antenna sections 33A, 34A formed on the film 31. The planar antenna 30A has the feeding point P (the coaxial cable 40 and the connecting section thereof). The antenna section 33A includes antenna elements 331, 332 and a coupling section 333A. The antenna section 34A includes antenna elements 341, 342 and a coupling section 343A.

The coupling section 333A is a conductor section which includes the cut lines (dotted lines) formed thereover and couples the antenna elements 331, 332 with each other. The length (width) in X direction of the coupling section 333A is same as a length in X direction (extending direction) of the antenna element 332. The cut lines of the coupling section 333A are made in borders between the antenna elements 331, 332 and the coupling section 333A, and a plurality of cut lines are made in a direction (Y direction) perpendicular to the extending direction of the antenna element 331, 332. The coupling section 343A also has the cut lines formed thereover similarly to the coupling section 333A.

Then, as shown in FIG. 5, a part of the coupling section 333A of an arbitrary length in X direction on the opposite side of the feeding point P is cut out. Similarly, a part of the coupling section 343A of an arbitrary length in X direction on the opposite side of the feeding point P is cut out. By this, the multiband planar antenna 30 is manufactured. The portion from which the part of the coupling section 333A is cut out becomes the clearance 35. The portion from the part of the coupling section 343A is cut out becomes the clearance 36.

Next, an operation of the multiband planar antenna 30 will be described with reference to FIGS. 6-14.

Figure 6:
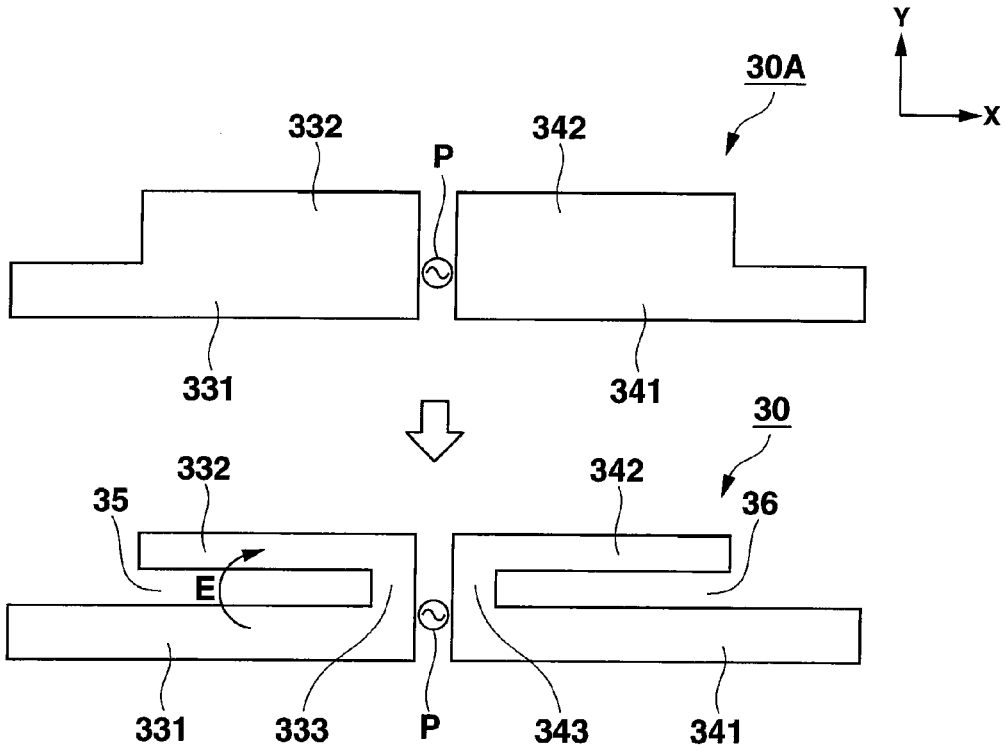
FIG. 6 is a diagram showing an electric field status in the multiband planar antenna according to the embodiment.

First, resonances at two frequency bands in the multiband planar antenna 30 will be explained with reference to FIG. 6. FIG. 6 shows an electric field status in the multiband planar antenna 30.

Figure 18:
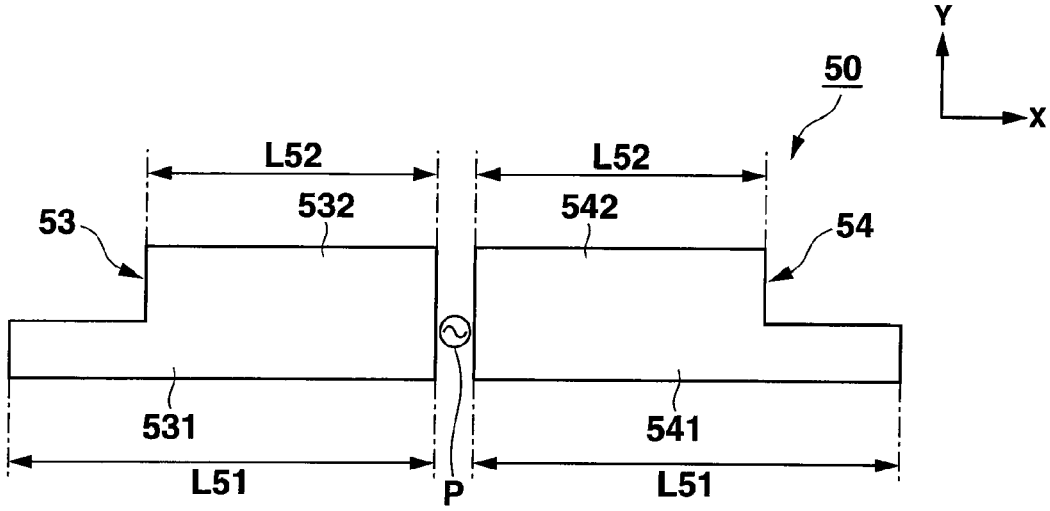
FIG. 18 is a diagram showing a schematic configuration of a conventional planar antenna having two sides of different lengths.
Figure 19:
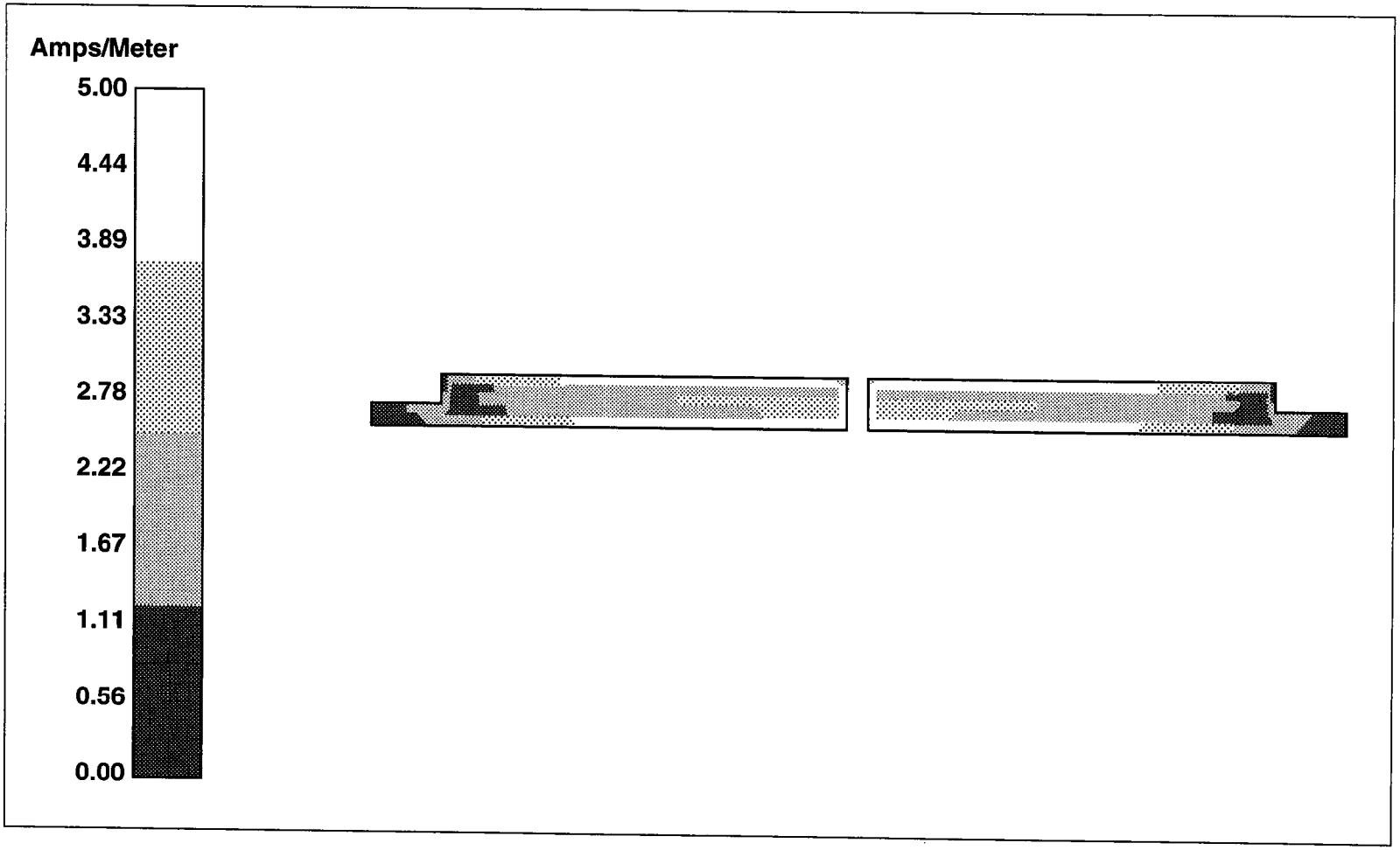
FIG. 19 is a diagram showing a current distribution of the conventional planar antenna.
Figure 20:
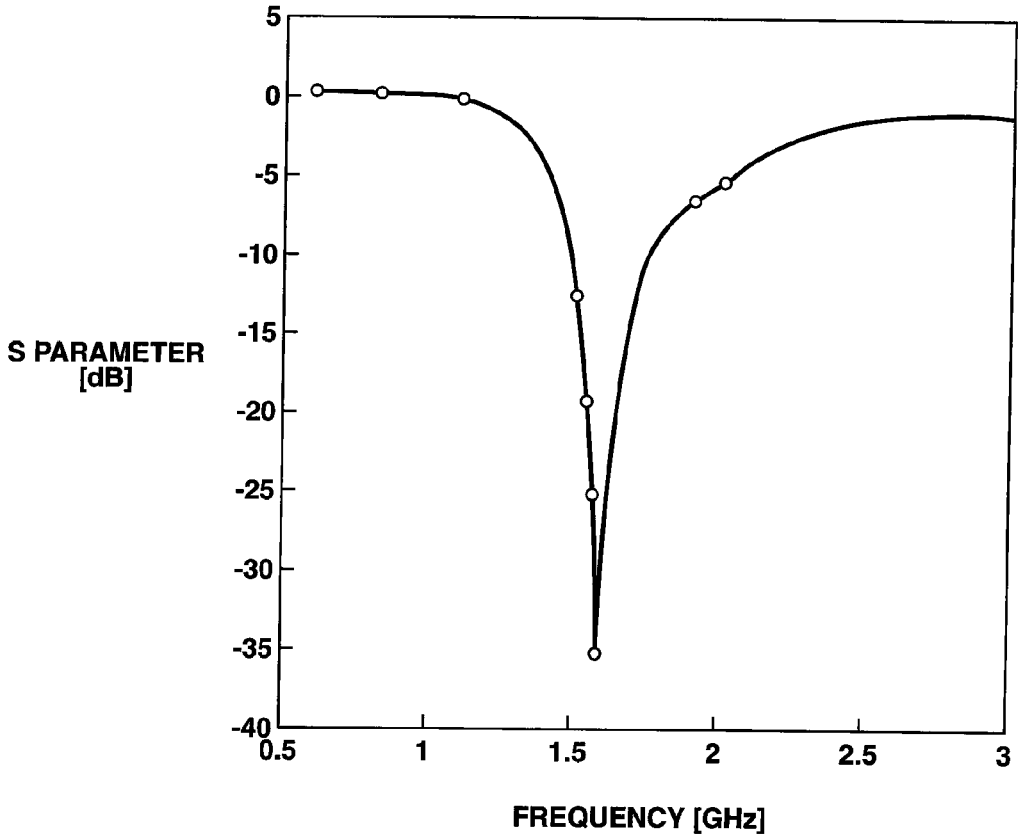
FIG. 20 is a diagram showing S parameter with respect to a frequency of the conventional planar antenna.

As shown in FIG. 6, similarly to the explanation about the conventional planar antenna 50 shown in FIG. 18, the planar antenna 30A is a single band planar antenna which resonates within one frequency band corresponding to a length (length of lower side) in X direction of the antenna element 331 (341). The resonance frequency of the planar antenna 30A becomes a frequency corresponding to wavelength λ1 when the length in X direction of the antenna element 331 (341) is λ¼ (λ1: wavelength of radio wave).

The multiband planar antenna 30 includes the clearance 35 and 36. When the multiband planar antenna 30 transmits/receives radio wave, an electric field E crossing the clearance 35 occurs between the antenna elements 331, 332. As a result, in the multiband planar antenna 30, resonance occurs at a resonance frequency corresponding to a wavelength λ2 when the length in X direction of the clearance 35 is λ¾. Similarly, in the multiband planar antenna 30, resonance occurs at a resonance frequency corresponding to a wavelength λ2 when the length in X direction of the clearance 36 is λ¾. By this, the multiband planar antenna 30 becomes a multiband antenna which resonates within the two frequency bands.

Next, resonance in the multiband planar antenna 30 will be described with reference to FIGS. 7-10.

Figure 7:
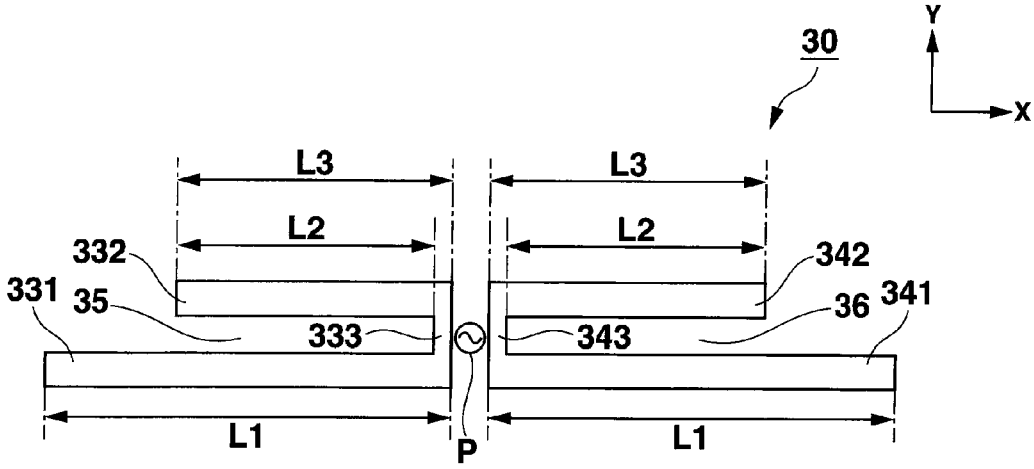
FIG. 7 is a diagram showing a length of each portion corresponding to a resonance frequency of the multiband planar antenna according to the embodiment.

FIG. 7 shows a length of each portion corresponding to the resonance frequency of the multiband planar antenna 30.

Figure 8:
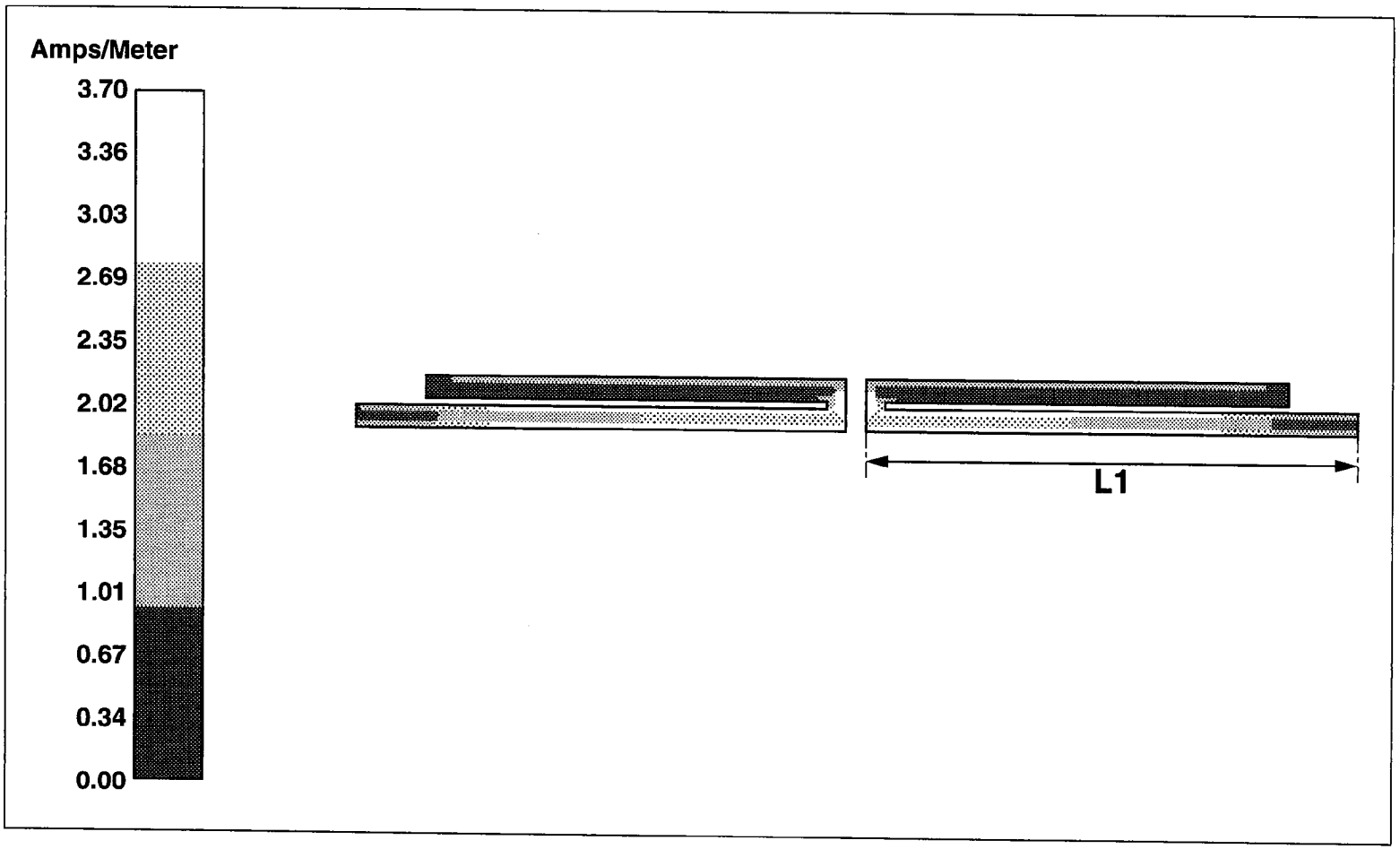
FIG. 8 is a diagram showing a current distribution in lower resonance frequency of the multiband planar antenna according to the embodiment.

FIG. 8 shows a current distribution in the lower resonance frequency f1 of the multiband planar antenna 30.

Figure 9:
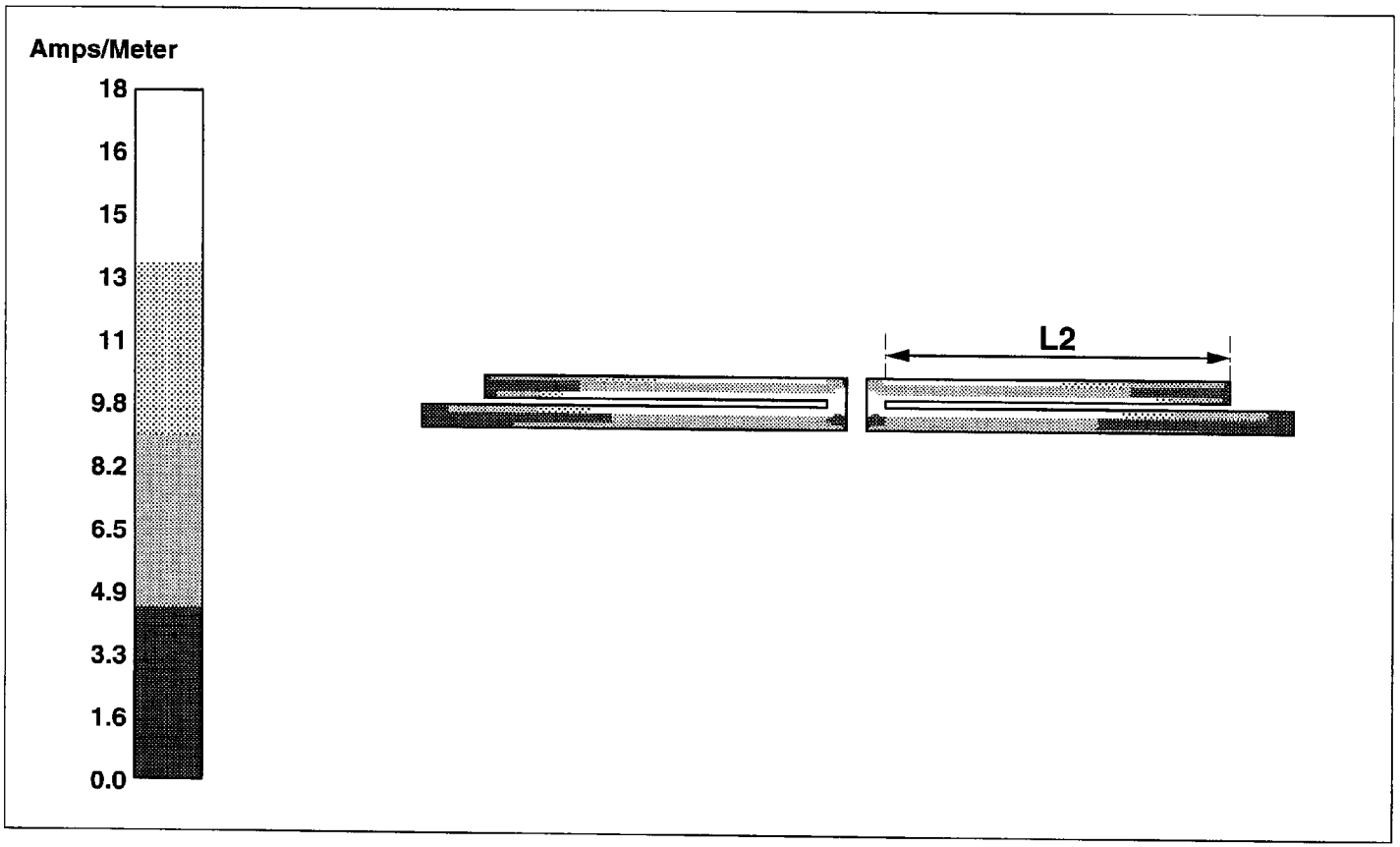
FIG. 9 is a diagram showing a current distribution in higher resonance frequency of the multiband planar antenna according to the embodiment.

FIG. 9 shows a current distribution in the higher resonance frequency of the multiband planar antenna 30.

Figure 10:
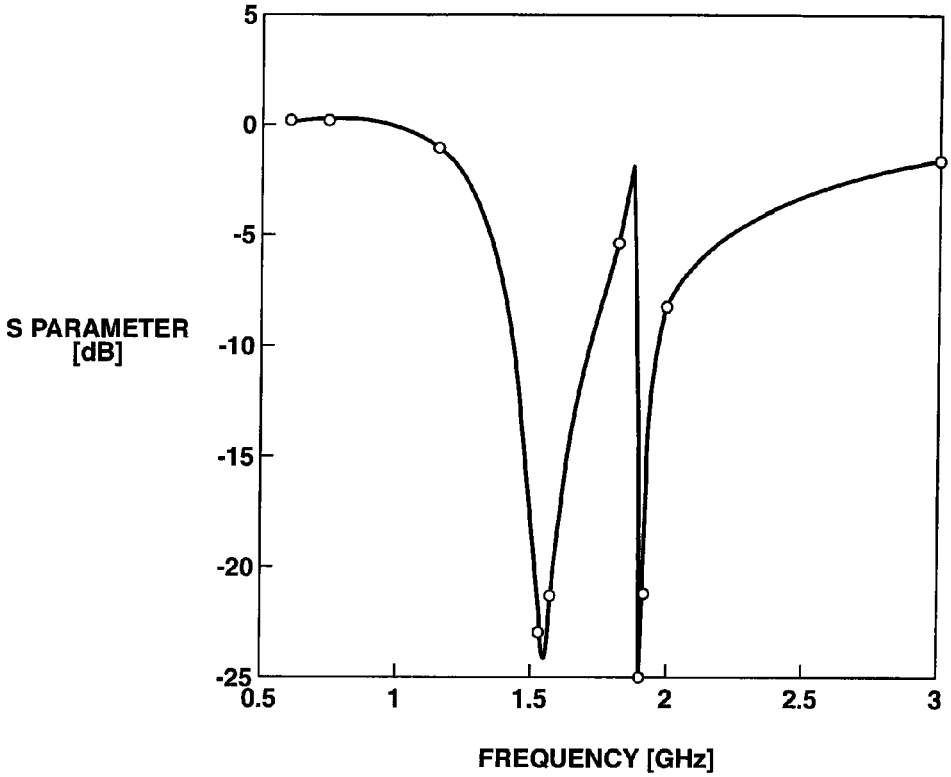
FIG. 10 is a diagram showing S parameter with respect to the frequency of the multiband planar antenna according to the embodiment.

FIG. 10 shows S parameter with respect to the frequency of the multiband planar antenna 30.

As shown in FIG. 7, a length (length of lower side) in X direction of the antenna element 331 (341) of the multiband planar antenna 30 is considered to be a length L1. A frequency corresponding to a wavelength λ1 in the case of L1=λ¼ (λ1: wavelength of radio wave) is considered to be a frequency f1. A length in X direction of the clearance 35 (36) of the multiband planar antenna 30 is considered as a length L2. A frequency corresponding to a wavelength λ2 in the case of L2=λ¾ (λ2: wavelength of radio wave) is considered to be a frequency f2. The frequencies f1, f2 are resonance frequencies f1, f2 at which resonance occurs in the multiband planar antenna 30. The resonance frequency f1 is set such that f1=1.57 [GHz], and the resonance frequency f2 is set such that f2=1.9 [GHz].

In addition, a length in X direction of the antenna element 332 (342) of the multiband planar antenna 30 is considered to be a length L3. The length L3 does not directly relate with the resonance.

An antenna current flowing through the multiband planar antenna 30 when it receives a radio wave of the lower resonance frequency was simulated. The simulation result becomes the current distribution shown in FIG. 8.

As shown in FIG. 8, a high antenna current flows through portions corresponding to the antenna elements 331, 341 of the multiband planar antenna 30 so that resonance occurs.

An antenna current flowing through the multiband planar antenna 30 when it receives a radio wave of the higher resonance frequency f2 was simulated. The simulation result becomes the current distribution shown in FIG. 9.

As shown in FIG. 9, a high antenna current flows though portions corresponding to the periphery of the clearances 35, 36 of the multiband planar antenna 30 so that resonance occurs.

As shown in FIG. 10, there are two drops at 1.57 [GHz] and 1.9 [GHz] frequencies in graph of S parameter of the multiband planar antenna 30. In other words, it is confirmed that the multiband planar antenna 30 is a multiband antenna to resonate at frequencies f1, f2.

Next, impedance adjustment of higher resonance frequency f2 in the multiband planar antenna 30 will be described with reference to FIGS. 11-13.

Figure 11:
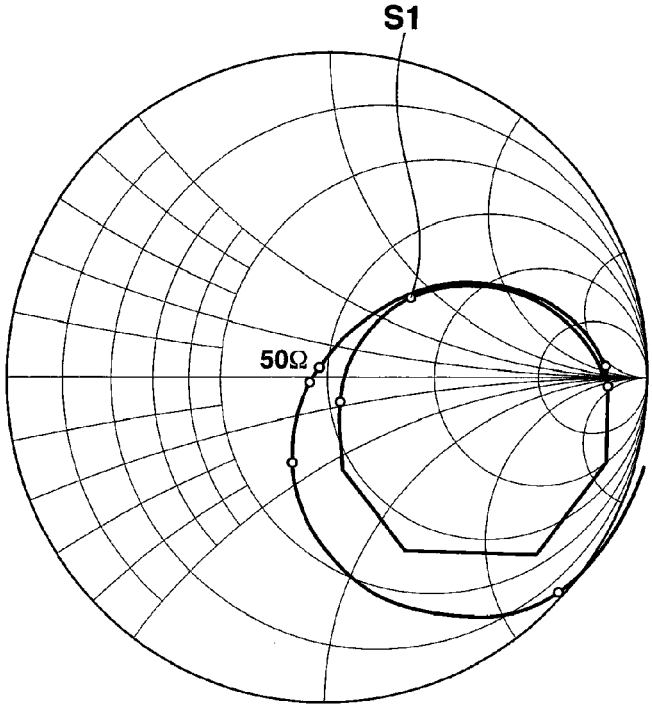
FIG. 11 is Smith chart in the case that a length of a clearance of the multiband planar antenna according to the embodiment is 20.5 [mm]

FIG. 11 shows Smith chart in the case that the length L2 of the clearance 35 (36) of the multiband planar antenna 30 is 20.5 [mm].

Figure 12:
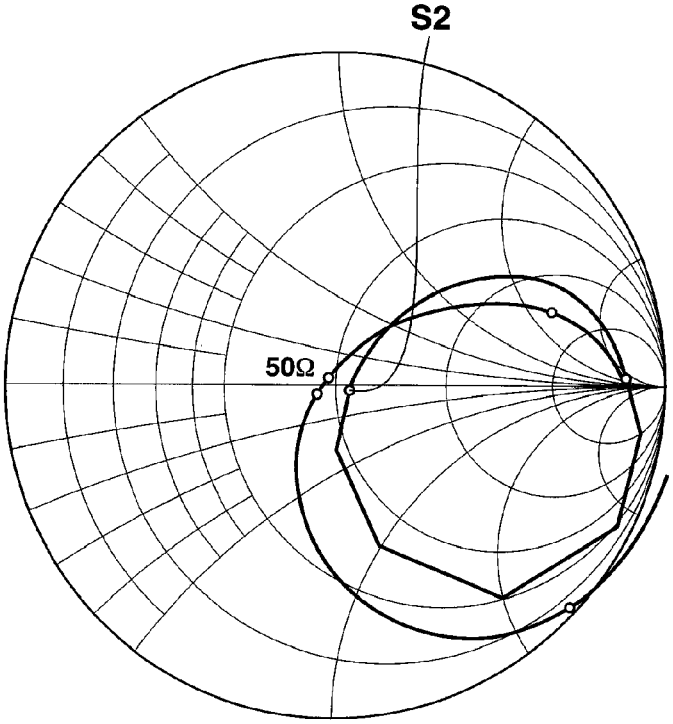
FIG. 12 is Smith chart in the case that a length of a clearance of the multiband planar antenna according to the embodiment is 20 [mm]

FIG. 12 shows Smith chart in the case that the length L2 of the clearance 35 (36) of the multiband planar antenna 30 is 20 [mm].

Figure 13:
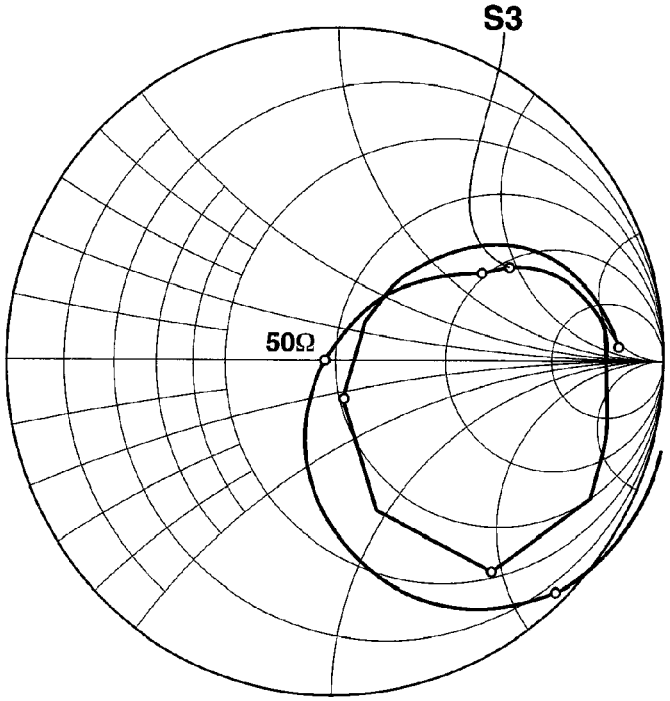
FIG. 13 is Smith chart in the case that a length of a clearance of the multiband planar antenna according to the embodiment is 16 [mm]

FIG. 13 shows Smith chart in the case that the length L2 of the clearance 35 (36) of the multiband planar antenna 30 is 16 [mm].

As an impedance judging condition of the Smith charts of FIGS. 11-13, the resonance frequency of the received radio wave of the multiband planar antenna 30 is set to 2 [GHz]. In FIGS. 11-13, impedance points at 2 [GHz] frequencies in the multiband planar antenna 30 are shown by reference numbers S1, S2 and S3 respectively. The central points of Smith charts of FIGS. 11-13 are 50 [Ω].

The impedance of the multiband planar antenna 30 when the frequency is 2 [GHz] is set to 50 [Ω] as the most appropriate impedance value. As shown in FIG. 11, when the length L2 is 20.5 [mm], the impedance of the multiband planar antenna 30 becomes 71.44 [Ω] at the point S1 of 2 [GHz] frequency. As shown in FIG. 12, when the length L2 is 20 [mm], the impedance of the multiband planar antenna 30 becomes 54.03 [Ω] at the point S2 of 2 [GHz] frequency. As shown in FIG. 13, when the length L2 is 16 [mm], the impedance of the multiband planar antenna 30 becomes 106.03 [Ω] at the point S3 of 2[GHz] frequency.

Thus, by changing the length L2, the impedance of the higher resonance frequency f2*a* can be changed. By using the Smith chart to allow the length L2 to be 20 [mm], the impedance of the multiband planar antenna 30 can be adjusted to about 50 [Ω] as an ideal value in 2 [GHz] frequency band which is higher resonance frequency. Even when the resonance frequency 2 [GHz] is replaced with the resonance frequency f2, the impedance within the frequency band of the resonance frequency f2 can be adjusted appropriately.

Next, an input impedance adjustment of the lower resonance frequency f1 in the multiband planar antenna 30 will be described with reference to FIG. 14.

Figure 14:
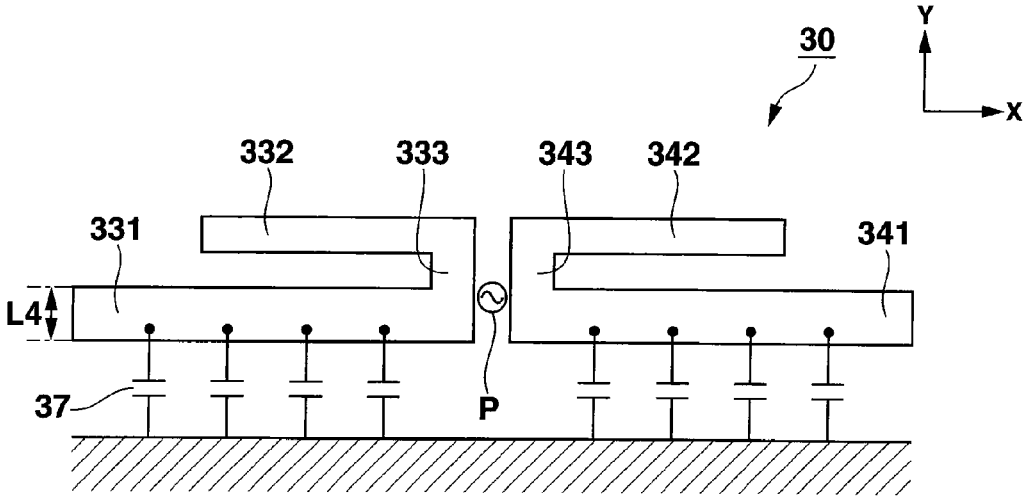
FIG. 14 is a diagram showing capacitor components to be generated in the multiband planar antenna according to the embodiment.

FIG. 14 shows capacitor components to be generated in the multiband planar antenna 30.

As shown in FIG. 14, capacitors 37 as apparent capacitor components are generated between the antenna elements 331, 341 of the multiband planar antenna 30, and a ground. A length in a short-side direction (Y direction) of the antenna elements 331, 341 is considered to be a length L4.

When the length L4 becomes larger, planar dimensions of the antenna elements 331, 341 as conductive bodies of the capacitors 37 become larger, and thereby capacitances C of the capacitors 37 become larger. The larger the capacitances C of the capacitors 37, the lower the input impedance corresponding to the resonance frequency f1 in the multiband planar antenna 30.

Thus, by adjusting the length L4, the input impedance of the resonance frequency f1 in the multiband planar antenna 30 can be adjusted to 50 [Ω] as the ideal value.

As described above, according to the embodiment, the multiband planar antenna 30 includes the antenna sections 33, 34 facing to each other across the feeding point P on the film 31. The antenna section 33 includes the antenna element 331 which has a length L1 in X direction and resonates at the resonance frequency f1, the antenna element 332, and the coupling section 333. The antenna section 34 includes the antenna element 341 which has a length L1 in X direction and resonates at the resonance frequency f1, the antenna element 342, and the coupling section 343. The length L2 in X direction of the clearance and the length L2 in X direction of the clearance 36 correspond to the resonance frequency f2 higher than the resonance frequency f1.

By this, since the multiband planar antenna 30 resonates at the resonance frequency f1 corresponding to the length L1 of the antenna elements 331, 341 and at the resonance frequency f2 corresponding to the length L2 of the clearance 35, 36, it is possible to provide two frequency bands in which resonance occurs in the planar antenna.

The length L2 of the clearance 35, 36 is adjusted to the length corresponding to the most appropriate impedance of about 50 [Ω] in the frequency band of the resonance frequency f2. By this, the impedance of the higher resonance frequency f2 of the multiband planar antenna 30 can be an appropriate value.

The planar dimensions of the antenna elements 331, 341 are adjusted to the dimensions corresponding to the most appropriate input impedance of about 50 [Ω] by adjusting the length L4. By this, the input impedance of the lower resonance frequency f1 of the multiband planar antenna 30 can be an appropriate value.

The multiband planar antenna 30 is manufactured by cutting out, from the coupling sections 333A, 343A including the cut lines by which the parts thereof having an arbitrary length in X direction can be cut out, the parts corresponding to the clearance 35, 36 by using the cut lines. BY this, the higher resonance frequency f2 can be easily adjusted to a desired value. In addition, the impedance of the higher resonance frequency f2 can be easily adjusted to an appropriate value.

The handheld terminal 1 is equipped with the multiband planar antenna 30, the wireless communication section 16, the GPS section 17 and the CPU 11. By this, by using the multiband planar antenna 30, communication can be performed while allowing the number of resonance frequency bands (frequency bands for receiving the GPS signal and for transmitting the W-CDMA) to be two.

(Variation)

The variation of the above-described embodiment will be described with reference to FIGS. 15-17. First, a configuration of a multiband planar antenna 30B of the variation will be explained with reference to FIGS. 15 and 16.

Figure 15:
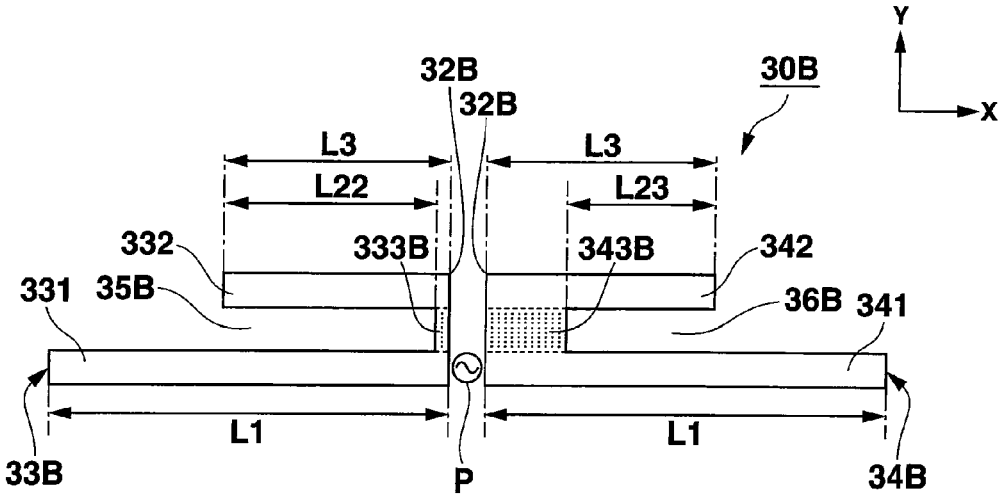
FIG. 15 is a diagram showing a planar configuration of a multiband planar antenna of a variation of the embodiment.

FIG. 15 shows a planar configuration of the multiband planar antenna 30B.

Figure 16:
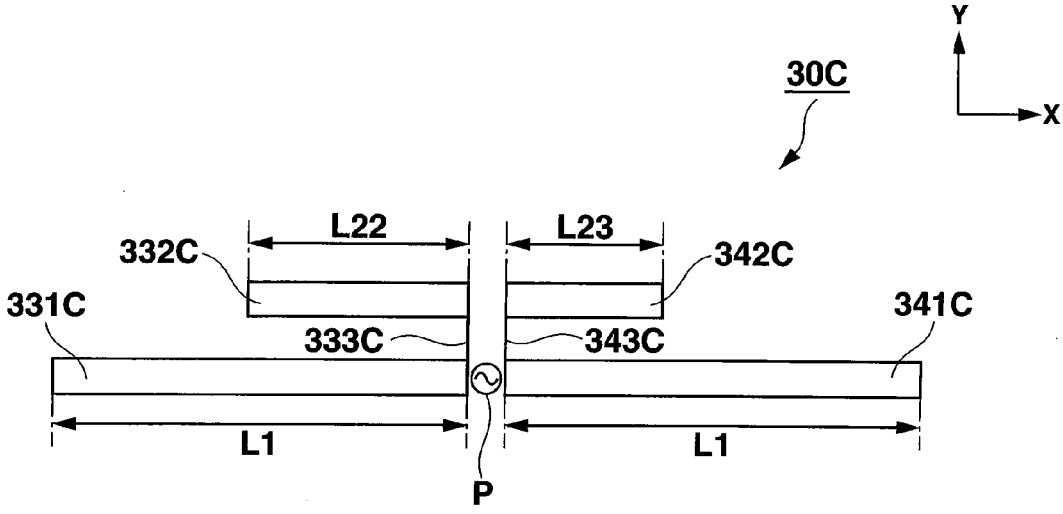
FIG. 16 is a diagram showing a configuration of a multiband dipole antenna equivalent to the multiband planar antenna of the variation.

FIG. 16 shows a configuration of a multiband dipole antenna 30C equivalent to the multiband planar antenna 30B.

In the device configuration of the variation, the multiband planar antenna 30 is replaced with the multiband planar antenna 30B in the handheld terminal 1. For this reason, the multiband planar antenna 30B will be mainly explained. The multiband planar antenna 30B is a multiband antenna as an unbalanced antenna having a three resonance frequency bands. The unbalanced antenna is an antenna in which electric potential is distributed unsymmetrically.

The multiband planar antenna 30 of the above-described embodiment resonates within two frequency bands. However, there has been a need for the multiband planar antenna to be a tri-band antenna which resonates within three frequency bands so as to perform combined communication of GPS communication system, upstream and downstream of W-CDMA system, and so on. For this reason, the multiband planar antenna 30B is configured to be a tri-band antenna. The multiband planar antenna 30B is, for example, a multiband antenna which resonates within three frequency bands of 1.57 [GHz] for GPS system, 1.9 [GHz] for upstream of W-CDMA system, and 2.1 [GHz] for downstream of W-CDMA.

Incidentally, the wireless communication section 16 demodulates an electric signal of received radio wave of W-CDMA input from the multiband planar antenna 30 to output it to the CPU 11, and modulates an electric signal of transmission data input from the CPU 11 and the like to output it to the multiband planar antenna 30 to transmit radio wave of W-CDMA.

As shown in FIG. 15, the multiband planar antenna 30B includes a film 31 (not shown) and an antenna inductor section 32B. The antenna inductor section 32B includes a first antenna section and antenna sections 33B, 34B as a second antenna section.

The antenna section 33B includes antenna elements 331, 332, a coupling section 333B as a first coupling section, a connecting section and a soldering pad (not shown). The antenna section 34B includes antenna elements 341, 342, a coupling section 343B as a second coupling section, a connecting section and a soldering pad (not shown). A rectangular portion of a plane surface between the antenna elements 331, 332 corresponding to a length in X direction of the antenna element 332 except the coupling section 333B is considered to be a clearance 35B as a first clearance. Similarly, a rectangular portion of a plane surface between the antenna elements 341, 342 corresponding to a length in X direction of the antenna element 342 except the coupling section 343B is considered to be a clearance 36B as a second clearance.

The coupling section 333B is similar to the coupling section 333, but the lengths in X direction are different from each other. The coupling section 343B is similar to the coupling section 343, but the lengths in X direction are different from each other. Similarly, the clearance 35B as the first clearance is similar to the clearance 35, but the lengths in X direction are different from each other. The clearance 36B as the second clearance is similar to the clearance 36, but the lengths in X direction are different from each other.

In other words, the multiband planar antenna 30B is manufactured by cutting out parts of the coupling sections 333A, 343A of the planar antenna 30A, similarly to the multiband planar antenna 30. A length in X direction of the clearance 35B is considered to be a length L22. The length in X direction of the clearance 36B is considered to be a length L23. The values of L22 and L33 are such that L22≠L23 and L1>L22>L23.

As shown in FIG. 16, the multiband dipole antenna 30C equivalent to the multiband planar antenna 30B includes antenna elements 331C, 332C, 341C, 342C and coupling sections 333C, 343C. A length in X direction of the antenna element 331C (341C) is a length L1. A length in X direction of the antenna element 332C is a length L22. A length in X direction of the antenna element 342C is a length L23.

A frequency corresponding to a wavelength λ22 in the case of L22=λ22/4 (λ22: wavelength of radio wave) is considered to be a frequency f22. A frequency corresponding to a wavelength λ23 in the case of L23=λ23/4 (λ23: wavelength of radio wave) is considered to be a frequency f23. The frequency f1 is set such that f1=1.57 [GHz], and the resonance frequency f22 is set such that f22=1.91 [GHz], and the resonance frequency f23 is set such that f23=2.12 [GHz].

Next, an operation of the multiband planar antenna 30B will be described with reference to FIG. 17.

Figure 17:
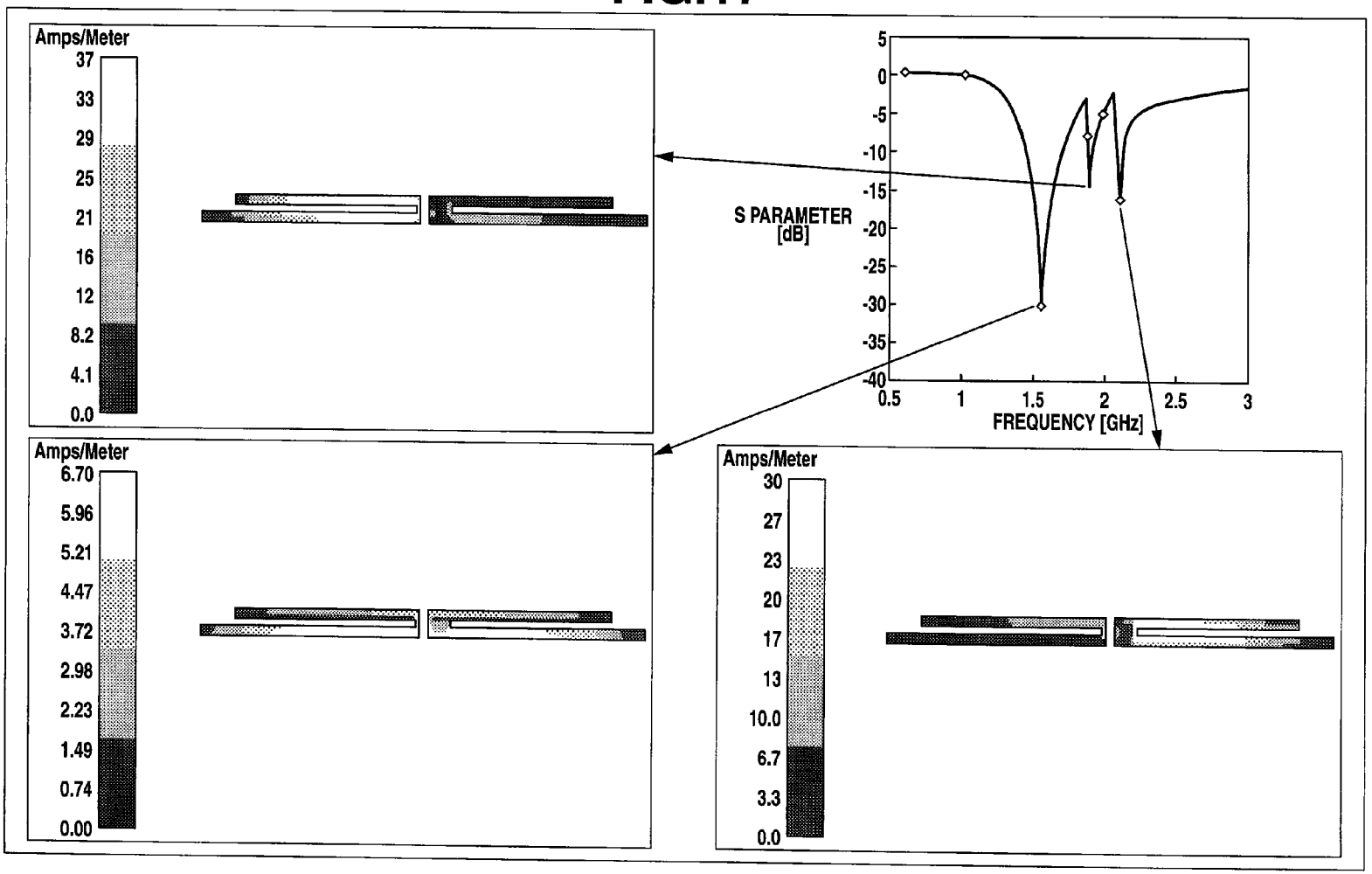
FIG. 17 is a diagram showing S parameter with respect to a frequency of the multiband planar antenna of the variation and a current distribution of each resonance frequency.

FIG. 17 shows S parameter with respect to the frequency of the multiband planar antenna 30B and a current distribution of each resonance frequency.

As shown in FIG. 17, there are three drops at 1.57 [GHz], 1.91 [GHz] and 2.12 [GHz] in graph of S parameter of the multiband planar antenna 30B. In other words, it is confirmed that the multiband planar antenna 30B is a multiband antenna to resonate at frequencies f1, f22 and f23.

An antenna current flowing through the multiband planar antenna 30B when it receives (or transmits) radio wave whose resonance frequencies are f1, f22 and f23 was simulated. The simulation result shows the current distribution shown in FIG. 17.

As shown in FIG. 17, a high antenna current flows through portions corresponding to the antenna elements 331, 341 correspondingly to the resonance frequency f1 of the multiband planar antenna 30B so that resonance occurs. Moreover, a high antenna current flows through portions corresponding to the periphery of clearance 35B correspondingly to the resonance frequency f22 of the multiband planar antenna 30B so that resonance occurs. Furthermore, a high antenna current flows through portions corresponding to the periphery of clearance 36B correspondingly to the resonance frequency f23 of the multiband planar antenna 30B so that resonance occurs.

As described above, according to the variation, in the multiband planar antenna 30B, the lengths L1 in X direction of the antenna elements 331, 341 are the length corresponding to the resonance frequency f1, and the length L22 in X direction of the clearance 35 is the length corresponding to the resonance frequency f22 higher than the resonance frequency f1, and the length L23 in X direction of the clearance 36B is the length corresponding to the resonance frequency f23 higher than the resonance frequencies f1, f22.

As a result, since the multiband planar antenna 30B resonates at the resonance frequency f1 corresponding to the lengths L1 of the antenna elements 331, 341, at the resonance frequency f22 corresponding to the length L22 of the clearance 35B, and at the resonance frequency f23 corresponding to the length L23 of the clearance 36B, it is possible to allow the number of resonance frequency bands in which resonance occurs in the planar antenna to be three (3).

The combination of three resonance frequency bands of the multiband planar antenna is not limited to the combination of frequency bands of 1.57 [GHz] for GPS communication, and 1.91 [GHz] for upstream and 2.1 [GHz] for downstream of W-CDMA communication, and other combinations of frequency bands may be adopted. For example, when considering the multiband planar antenna to be an antenna for overseas mobile communication system, a configuration to resonates at three frequency bands among 850 [MHz], 900 [MHz], 1.8 [GHz] and 1.9 [GHz] for Global System for Mobile Communications may be adopted.

The descriptions in the above embodiment and variation are examples of the multiband planar antenna and the equipment according to the present invention, which is not limited to the examples.

For example, a configuration where the embodiment (adjusting the impedance and the like) and the variation are combined may be also adopted.

The handheld terminal is used as the equipment in the embodiment and variation, but it is not limited to the above. As the equipment, other equipment such as PDA, a mobile phone, a laptop personal computer (PC) may be used.

The handheld terminal 1 is configured to have a data communication function by mobile communication using the multiband planar antenna 30 and the wireless communication section 16 in the embodiment and variation, but it is not limited to the above. For example, a configuration of the handheld terminal 1 to include a telephone section including a speaker and a microphone and to have a telephone function by mobile communication using the multiband planar antenna 30 and the telephone section 30.

The embodiment and variation adopts a configuration where the antenna induction section 32 of the multiband planar antenna 30 faces to the side of the case section 2, but it is not limited to the above. For example, a configuration where the film 31 of the multiband planar antenna 30 faces to the side of the case section 2 may be adopted. A configuration where an insulating layer of an insulating body is further provided on the antenna induction section 32 formed on the film 31 may be adopted.

It is needless to say that detailed configurations of each component of the multiband planar antennas 30, 30B and the handheld terminal 1 and detailed operations thereof can be changed appropriately without departing from the spirit of the present invention.

All of the disclosures including the patent specification, the claims, the attached drawings and the abstract of Japanese Patent Application No. 2009-127122 filed on May 27, 2009 are herein incorporated by reference.

What is claimed is:

1. A multiband planar antenna comprising:

an insulating film;

a first antenna section formed on the film; and a second antenna section formed on the film, the second antenna being placed so as to face to the first antenna section across a feeding point, wherein the first antenna section includes:

a first antenna element including a side having a length in an extending direction that corresponds to a first resonance frequency, the first antenna element having a band-like shape;

a second antenna element placed at a predetermined distance from the first antenna element so as to be in parallel with the first antenna element, the second antenna element being shorter than the first antenna element and having a band-like shape; and a first coupling section to couple the first antenna element with the second antenna element, wherein the first antenna section has a first clearance that is between the first antenna element and the second antenna element and corresponds to a length in the extending direction of the second antenna element except for the first coupling section, wherein the second antenna section includes:

a third antenna element including a side having a length in an extending direction that corresponds to the first resonance frequency, the third antenna element having a band-like shape;

a fourth antenna element placed at a predetermined distance from the third antenna element so as to be in parallel with the third antenna element, the fourth antenna element being shorter than the third antenna element and having a band-like shape; and a second coupling section to couple the third antenna element with the fourth antenna element, wherein the second antenna section has a second clearance that is between the third antenna element and the fourth antenna element and corresponds to a length in the extending direction of the fourth antenna element except the second coupling section, wherein a length in the extending direction of the first clearance and a length in the extending direction of the second clearance are different from each other, wherein the length in the extending direction of the first clearance is a length which corresponds to a second resonance frequency that is higher than the first resonance frequency, and wherein the length in the extending direction of the second clearance is a length which corresponds to a third resonance frequency that is higher than the first resonance frequency and the second resonance frequency.

2. The multiband planar antenna according to claim 1, wherein the length in the extending direction of the first clearance corresponds to a proper impedance in a frequency band of the second resonance frequency, and the length in the extending direction of the second clearance corresponds to a proper impedance in a frequency band of the third resonance frequency.

3. The multiband planar antenna according to claim 1, wherein the first antenna element has a planar dimension which corresponds to a proper impedance in the second resonance frequency, and the third antenna element has a planar dimension which corresponds to a proper impedance in the third resonance frequency.

4. The multiband planar antenna according to claim 1, wherein the first coupling section is made by cutting out a part of a coupling section which connects the first antenna element and the second antenna element and includes a cut line for cutting out the part of an arbitrary length in the extending direction by using the cut line, and wherein the second coupling section is made by cutting out a part of a coupling section which connects the third antenna element and the fourth antenna element and includes a cut line for cutting out the part of an arbitrary length in the extending direction by using the cut line.

5. Electronic equipment comprising:

(i) a multiband planar antenna including: an insulating film; a first antenna section formed on the film; and a second antenna section formed on the film, the second antenna being placed so as to face to the first antenna section across a feeding point, wherein the first antenna section includes:

a first antenna element including a side having a length in an extending direction that corresponds to a first resonance frequency, the first antenna element having a band-like shape;

a second antenna element placed at a predetermined distance from the first antenna element so as to be in parallel with the first antenna element, the second antenna element being shorter than the first antenna element and having a band-like shape; and a first coupling section to couple the first antenna element with the second antenna element, wherein the first antenna section has a first clearance that is between the first antenna element and the second antenna element and corresponds to a length in the extending direction of the second antenna element except for the first coupling section, and wherein the second antenna section includes:

a third antenna element including a side having a length in an extending direction that corresponds to the first resonance frequency, the third antenna element having a band-like shape;

a fourth antenna element placed at a predetermined distance from the third antenna element so as to be in parallel with the third antenna element, the fourth antenna element being shorter than the third antenna element and having a band-like shape; and a second coupling section to couple the third antenna element with the fourth antenna element, wherein the second antenna section has a second clearance that is between the third antenna element and the fourth antenna element and corresponds to a length in the extending direction of the fourth antenna element except for the second coupling section, wherein a length in the extending direction of the first clearance and a length in the extending direction of the second clearance are different from each other, wherein the length in the extending direction of the first clearance is a length which corresponds to a second resonance frequency that is higher than the first resonance frequency, and wherein the length in the extending direction of the second clearance is a length which corresponds to a third resonance frequency that is higher than the first resonance frequency and the second resonance frequency;

(ii) a communication section to perform wireless communication with external equipment through the multiband planar antenna; and (iii) a control section to control the communication section.

* * * * *